US009205389B2

(12) United States Patent
Hwang

(10) Patent No.: US 9,205,389 B2
(45) Date of Patent: Dec. 8, 2015

(54) AGITATING VESSEL USING BAFFLES AND AGITATOR HAVING IMPROVED AGITATING CAPABILITY AND INCLUDING THE SAME

(75) Inventor: Wook Ryol Hwang, Jinju-si (KR)

(73) Assignee: INDUSTRY-ACADEMIC COOPERATION FOUNDATION GYEONGSANG NATIONAL UNIVERSITY (KR)

( * ) Notice: Subject to any disclaimer, the term of this patent is extended or adjusted under 35 U.S.C. 154(b) by 1029 days.

(21) Appl. No.: 13/125,170

(22) PCT Filed: Oct. 6, 2009

(86) PCT No.: PCT/KR2009/005696

§ 371 (c)(1),
(2), (4) Date: Apr. 20, 2011

(87) PCT Pub. No.: WO2010/047481

PCT Pub. Date: Apr. 29, 2010

(65) Prior Publication Data

US 2011/0199856 A1 Aug. 18, 2011

(30) Foreign Application Priority Data

Oct. 21, 2008 (KR) ..... 10-2008-0103228

(51) Int. Cl.
*B01F 5/06* (2006.01)
*B01F 7/00* (2006.01)
(Continued)

(52) U.S. Cl.
CPC ..... *B01F 7/22* (2013.01); *B01F 7/1675* (2013.01); *B01F 15/00883* (2013.01)

(58) Field of Classification Search
CPC ..... B01F 15/00883; B01F 7/1675
USPC ..... 366/307, 165.3, 171.1, 181.4, 181.5, 366/306, 304
See application file for complete search history.

(56) References Cited

U.S. PATENT DOCUMENTS 2,082,796 A * 6/1937 Gaertner ..... B01F 7/1675 366/307
2,159,856 A * 5/1939 MacLean ..... 366/307
(Continued)

FOREIGN PATENT DOCUMENTS

DE 3330456 3/1985
FR 2227898 11/1974
(Continued)

OTHER PUBLICATIONS

International Search Report—PCT/KR2009/005696 dated May 3, 2010.
(Continued)

*Primary Examiner* — Joseph S Del Sole
*Assistant Examiner* — Nahida Sultana
(74) *Attorney, Agent, or Firm* — Cantor Colburn LLP

(57) ABSTRACT

An agitating vessel of an agitator mixing fluid comprising: a body having a hollow inner space so that fluid is stored therein; a rotating unit installed inside the hollow inner space to agitate the fluid; and a horizontal baffle having a plate shape, one end of which is attached to and along an inner wall surface of the hollow inner space of the body and the other end of which is a free end. The plate shape of the baffle is formed in a vertical direction to a central shaft of the rotating unit and in parallel with a bottom surface of the hollow inner space of the body so that two rotations of the fluid are formed above and under the horizontal baffle. The baffle forms a single piece of plate and is extended and attached to the inner wall surface around the central shaft.

3 Claims, 11 Drawing Sheets

(51) Int. Cl.

| | |
|---|---|
| ***B01F 7/22*** | (2006.01) |
| ***B01F 7/16*** | (2006.01) |
| ***B01F 15/00*** | (2006.01) |

(56) References Cited

U.S. PATENT DOCUMENTS

| | | | | |
|---|---|---|---|---|
| 3,092,678 | A * | 6/1963 | Braun | 261/30 |
| 3,285,705 | A | 11/1966 | Zuiderweg et al. | |
| 3,399,014 | A * | 8/1968 | Butterfield | G02B 15/14 359/683 |
| 4,650,338 | A * | 3/1987 | List | A21C 1/06 366/298 |
| 5,292,193 | A * | 3/1994 | Funk | 366/307 |
| 5,549,854 | A * | 8/1996 | Hulthom | B01F 3/04531 261/123 |
| 5,762,417 | A * | 6/1998 | Essen et al. | 366/264 |
| 5,816,702 | A | 10/1998 | Mays et al. | |
| 6,024,481 | A * | 2/2000 | Hillstrom et al. | 366/155.1 |
| 6,030,113 | A * | 2/2000 | Bergman | B01F 7/00641 366/264 |
| 6,059,448 | A * | 5/2000 | Reeder | B01F 7/1675 366/306 |
| 6,207,055 | B1 * | 3/2001 | Satterfield et al. | 210/607 |
| 6,508,583 | B1 * | 1/2003 | Shankwitz et al. | 366/196 |
| 6,814,481 | B2 * | 11/2004 | Colombo | 366/80 |
| 7,607,821 | B2 * | 10/2009 | Schmidt | 366/307 |
| 7,704,465 | B2 * | 4/2010 | Kato et al. | 422/225 |
| 8,596,858 | B2 * | 12/2013 | Ohashi et al. | 366/171.1 |
| 2003/0227817 | A1 * | 12/2003 | Martel et al. | 366/142 |
| 2006/0176771 | A1 * | 8/2006 | Adams | 366/270 |
| 2008/0025143 | A1 * | 1/2008 | Ohashi et al. | 366/181.4 |
| 2009/0207689 | A1 * | 8/2009 | Artusi | 366/140 |
| 2009/0238033 | A1 * | 9/2009 | Wyczalkowski | 366/305 |

FOREIGN PATENT DOCUMENTS

| | | |
|---|---|---|
| JP | 60-034728 | 2/1985 |
| JP | 2001-198444 | 7/2001 |
| JP | 2001340735 | 12/2001 |
| JP | 2011198444 | 10/2011 |
| SU | 1567256 | 5/1990 |
| WO | 8903722 | 5/1989 |

OTHER PUBLICATIONS

Japanese Office Action—Japanese Application No. 2011-533094 issued on Jul. 3, 2012, citing JP2011-198444.

European Search Report—European Application No. 09822157.5 issued on May 18, 2015, citing U.S. Pat. No. 6 207 055, U.S. Pat. No. 5 816 702, U.S. Pat. No. 3 285 705, FR 2 227 898, WO 89/03722, DE 33 30 456 and SU 1 567 256.

* cited by examiner

AGITATING VESSEL USING BAFFLES AND AGITATOR HAVING IMPROVED AGITATING CAPABILITY AND INCLUDING THE SAME

TECHNICAL FIELD

The present invention is related to an agitating vessel using baffles and an agitator having improved agitating capability and including the same, and more particularly, to an agitating vessel using baffles that has a simple structure in which a horizontal baffle is formed over a predetermine area and that are capable of significantly improving mixing performance of an agitator using the chaos fluid mixing theory, and an agitator having improved agitating capability and including the same.

BACKGROUND ART

An agitator, which is a device for mixing more than two fluid materials, has been widely used over various industrial fields such as chemical engineering, paper making, petroleum industry, heavy industry, or the like.

An example of the agitator according to the related art is shown in FIG. 1. The agitator 10 according to the related art is configured to include a body 1 having a space 2 formed in a hollow inner portion thereof so that fluid may be stored therein; a shaft 3 formed in a central portion of the inner portion of the body 1; a plurality of wings 4 radially formed from the shaft 3, and an impeller 5 rotated by a driving unit (not shown).

The impeller rotates by the shaft formed in the central portion of the body, such that the agitator mixes fluid.

Here, the size, the forming angle, the shape and/or the like of the impeller or the wings are controlled to thereby improve the mixing performance of the agitator. Regardless of the size, forming angle and/or the like of the impeller or the wings, a key dynamical systems structure consisting of two rotational flows remains unchanged. That is, a direct circumferential rotation of fluid materials generated by the shaft by rotation of the impeller and a secondary cross-sectional rotation of fluid materials generated by inertia or a cross-sectional rotational flow generated by an axial flow formed by the impeller. As a result, the dynamical systems structure forms a donut-like streamed surface structure (the toroidal dynamical systems), as shown in FIG. 2. In the case of highly viscous materials (polymeric fluids, emulsions, suspensions, paints, food materials, or the like), the streamed surface stays unchanged forming an invariant surface, due to the absence of turbulent mixing mechanisms (See FIG. 2). In this case, the motion of fluid material is limited such that it moves only along the initially determined streamlined surface during the mixing process, and thereby significantly deteriorated the mixing performance is expected.

DISCLOSURE

Technical Problem

An object of the present invention is to provide an agitating vessel using baffles that has a simple structure in which a horizontal baffle is additionally installed and that generates chaotic flows to thereby enforce fluid materials to be transported more effectively, and an agitator having improved agitating capability and including the same.

Technical Solution

In one general aspect, an agitating vessel 100 of an agitator 1000 mixing fluid includes: a body 110 having a space 111 formed in a hollow inner portion thereof so that fluid is stored therein; and a horizontal baffle 130 formed to have a plate shape in a vertical direction to a central shaft of the body 110.

The baffle 130 may have an angle $\alpha$ that is in the range of 90 to 270 degrees formed based on the central shaft, when viewing an inner side of the body 110 from the top.

The baffle 130 may be formed in plural.

In another general aspect, an agitating vessel 100 of an agitator 1000 mixing fluid includes: a body 110 having a space 111 formed in a hollow inner portion thereof so that fluid is stored therein; and a horizontal baffle 130 formed to have a plate shape in a vertical direction to a central shaft of the body 110 and spirally formed along an inner wall surface of the body.

In another general aspect, an agitating vessel 100 of an agitator 1000 mixing fluid includes: a body 110 having a space 111 formed in a hollow inner portion thereof so that fluid is stored therein; and a vertical baffle 130 formed in a vertical direction to a bottom surface of the body 110.

In another general aspect, an agitator 1000 having improved agitating capability includes: the agitating vessel 100 as described above; and a rotating unit 120 rotating fluid in the agitating vessel 100.

Advantageous Effects

Therefore, with the agitating vessel using baffles and the agitator having improved agitating capability and including the same according to the present invention, the baffle is formed in a predetermined area in a horizontal direction to allow the motion of fluid materials to be divided into different types of flows by the baffle during the process of being mixed, such that the donut-like rotational flow is disturbed in a spatially periodic way, thereby facilitating further improvement in the mixing efficiency.

More specifically, with the agitating vessel using baffles and the agitator having improved agitating capability and including the same according to the present invention, fluid materials experience periodically completely different streamlined surfaces (dynamical systems structure) as fluid materials rotate circumferentially during the mixing and therefore a donut-like toroidal dynamical structure of the invariant streamlined surface is destroyed by the chaos theory, thereby making it possible to expect that mixing performance is improved.

DETAILED DESCRIPTION OF MAIN ELEMENTS

| | |
|---|---|
| 1000: AGITATOR | |
| 100: AGITATING VESSEL HAVING IMPROVED AGITATING CAPABILITY | |
| 110: BODY | 111: SPACE |
| 120: ROTATING UNIT | 121: SHAFT |
| 122: WING | |
| 130: BAFFLE | |
| α: ANGLE OF BAFFLE | |
| β: ANGLE OF SPIRAL BAFFLE | |

BEST MODE

Hereinafter, an agitating vessel 100 using baffles 130 and an agitator 1000 having improved agitating capability and including the same according to an exemplary embodiment of the present invention having the above-mentioned feature will be described in detail with reference to the accompanying drawings.

Figure 3:
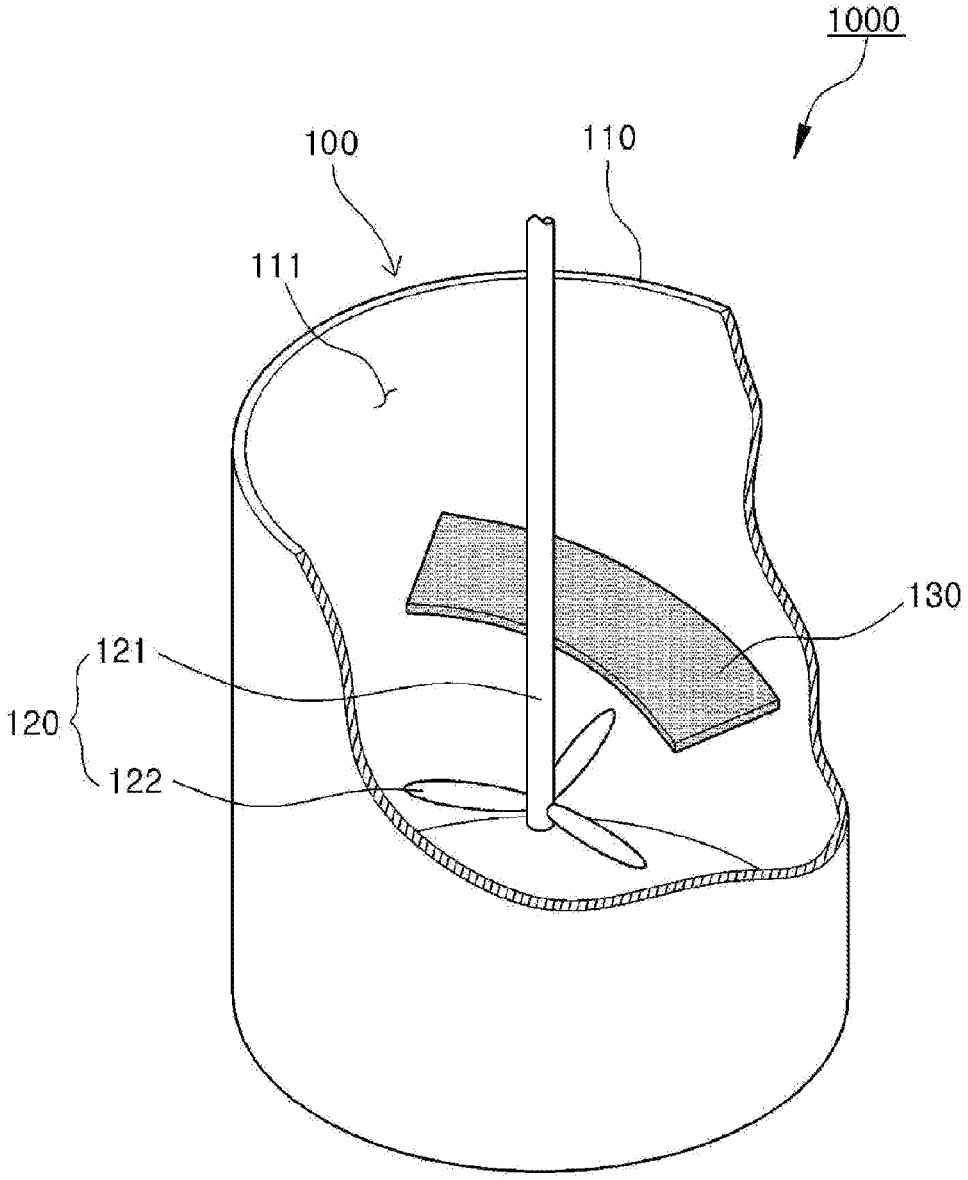
FIG. 3 is a cut-away perspective view showing an agitator having improved agitating capability according to an exemplary embodiment of the present invention.
Figure 4:
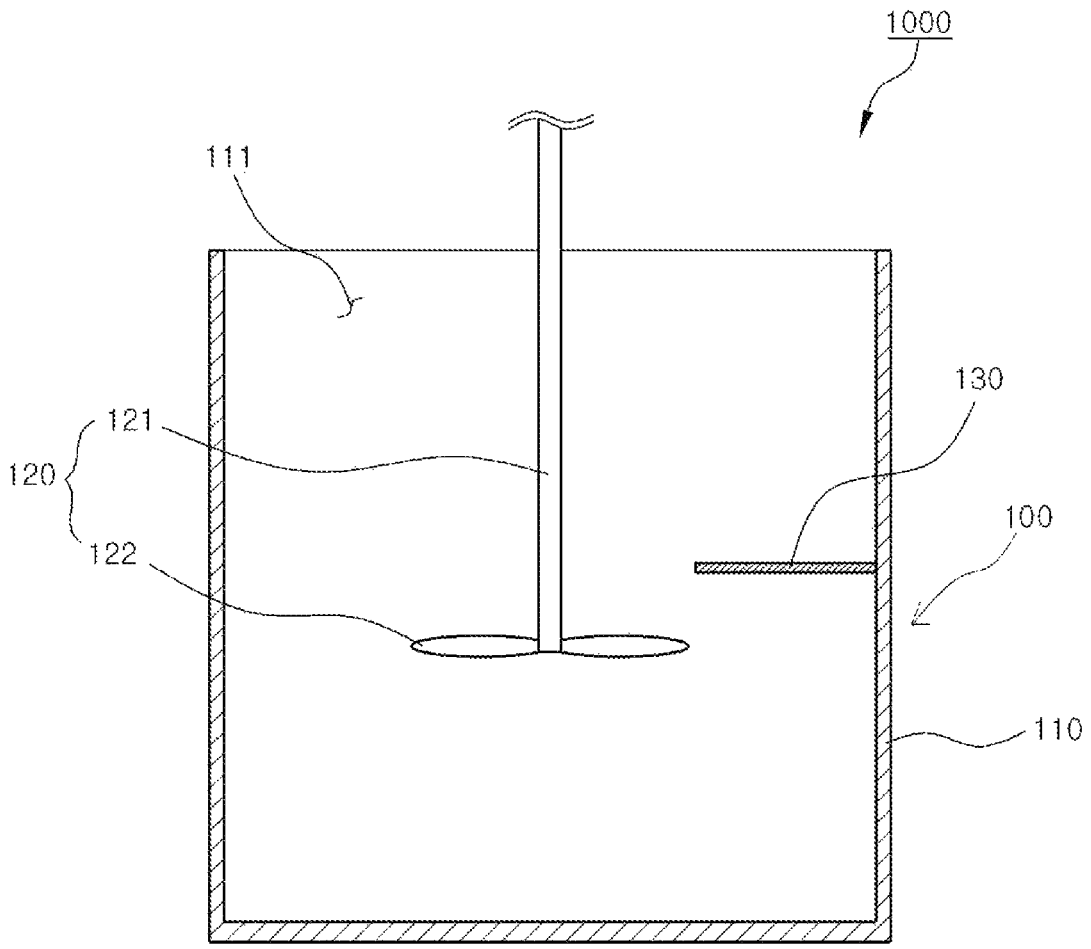
FIG. 4 is a cross-sectional view of the agitator having improved agitating capability shown in FIG. 3.
Figure 5:
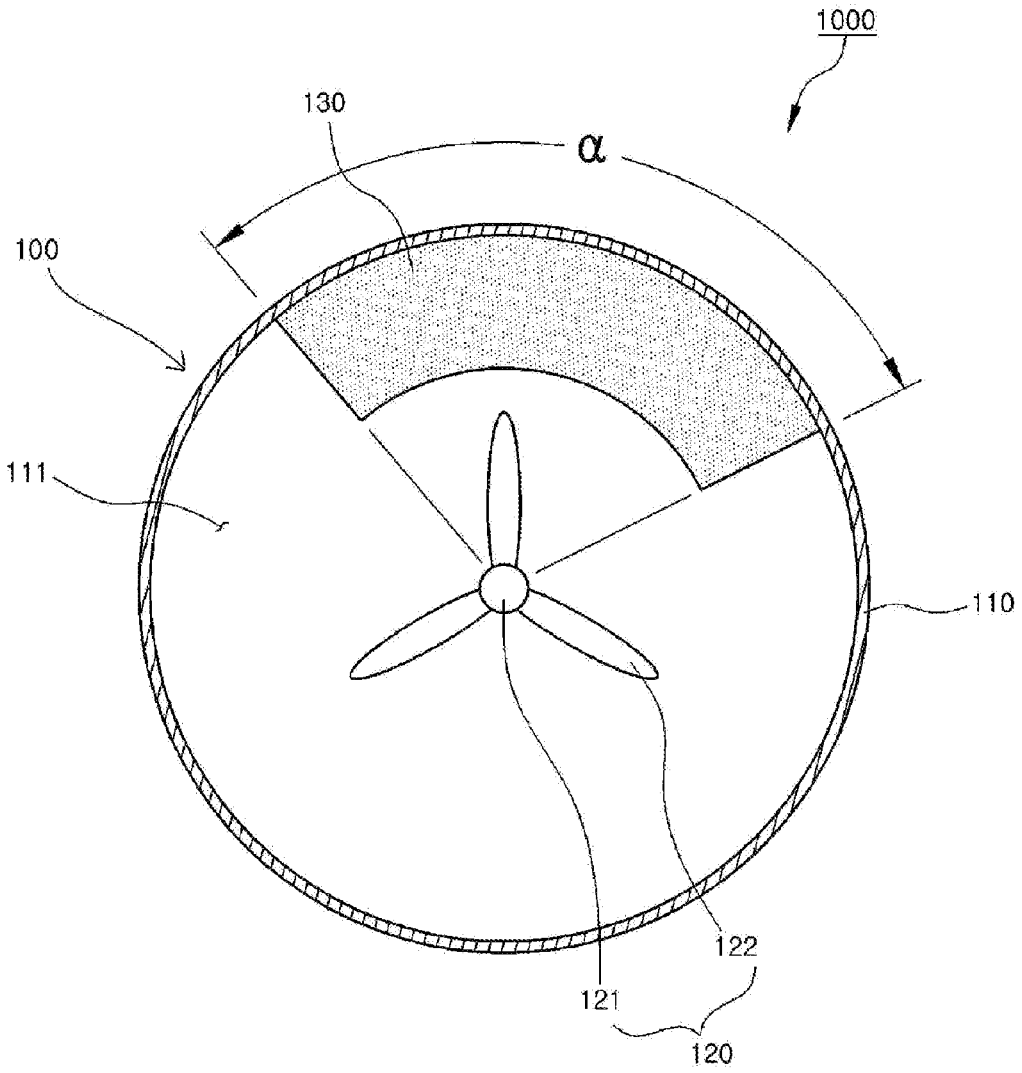
FIG. 5 is a top view of the agitator having improved agitating capability shown in FIG. 3.
Figure 6:
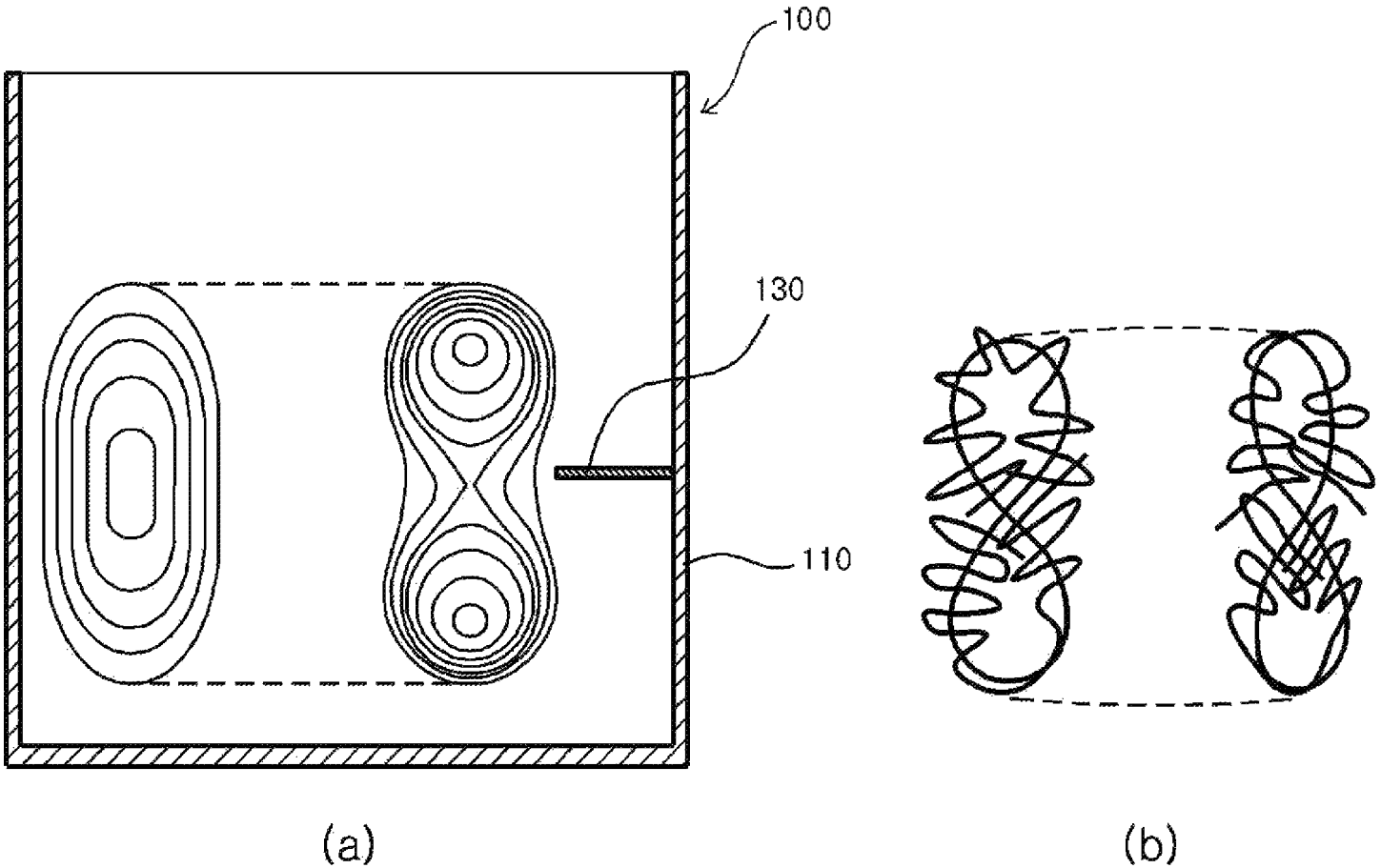
FIG. 6A is a schematic view showing two distinctive cross-sectional dynamical systems structures of the fluid motion in an agitating vessel of the agitator shown in FIG. 3.
FIG. 6B is a schematic view showing a perturbed dynamical systems structure of the fluid motion due to spatially periodic experience of two distinct cross-sectional dynamical systems shown in FIG. 6A.

FIG. 3 is a cut-away perspective view showing an agitator 1000 having improved agitating capability according to an exemplary embodiment of the present invention; FIG. 4 is a cross-sectional view of the agitator 1000 having improved agitating capability shown in FIG. 3; FIG. 5 is a top view of the agitator 1000 having improved agitating capability shown in FIG. 3; and FIG. 6 is a schematic view showing dynamical systems structures of the fluid motion in an agitating vessel 100 of the agitator 1000 shown in FIG. 3.

The agitator 1000 having improved agitating capability according to en exemplary embodiment of the present invention is mainly configured to include an agitating vessel 100 including a body 110 and a baffle 130, and a rotating unit 120 rotating fluid contained in the agitating vessel 100.

The agitating vessel 100 will be first described.

The body 110, which is a basic component configuring the agitating vessel 100, may have a space 111 formed therein, the space having a predetermined volume formed so that fluid may be stored therein.

Although the drawing has shown a form in which a top side of the body 110 is opened, the top side of the body 110 may be closed by a separate cover so that the fluid does not flow out to the outside during the operation of the agitator 1000 (rotation of the rotating unit 120). In addition, a discharging part discharging the fluid may be separately formed at a bottom side of the body 110.

Also, although FIG. 5 has shown an example in which the body 110 has a circular cross-section, the agitator 1000 having improved agitating capability according to the exemplary embodiment of the present invention is not limited to having the circular cross-section but may have various shapes of cross-sections.

The baffle 130 is formed in a vertical direction to a central shaft in the body 110, that is, a direction that is in parallel with a bottom surface of the body 110. Here, the vertical direction to the central shaft indicates a direction forming an angle of 90 degrees to the central shaft.

Although the drawings have shown an impeller including a shaft 121 formed in the center of the body 110 and a plurality of wings 122 radially formed from the shaft 121 as the rotating unit 120, a unit rotating the agitating vessel 100 itself or rotating the fluid using vibration, or the like, may also be used, in addition to the shape shown in the drawings. Furthermore, any unit capable of rotating the fluid stored in the agitating vessel 100 may be used.

A case in which the impeller is used as the rotating unit 120 will be described in more detail. The impeller allows the fluid to be mixed by rotation thereof. The number, the shape, and the like, of the wings 122 may be variously changed without being limited to the example shown in the drawings.

Figure 1:
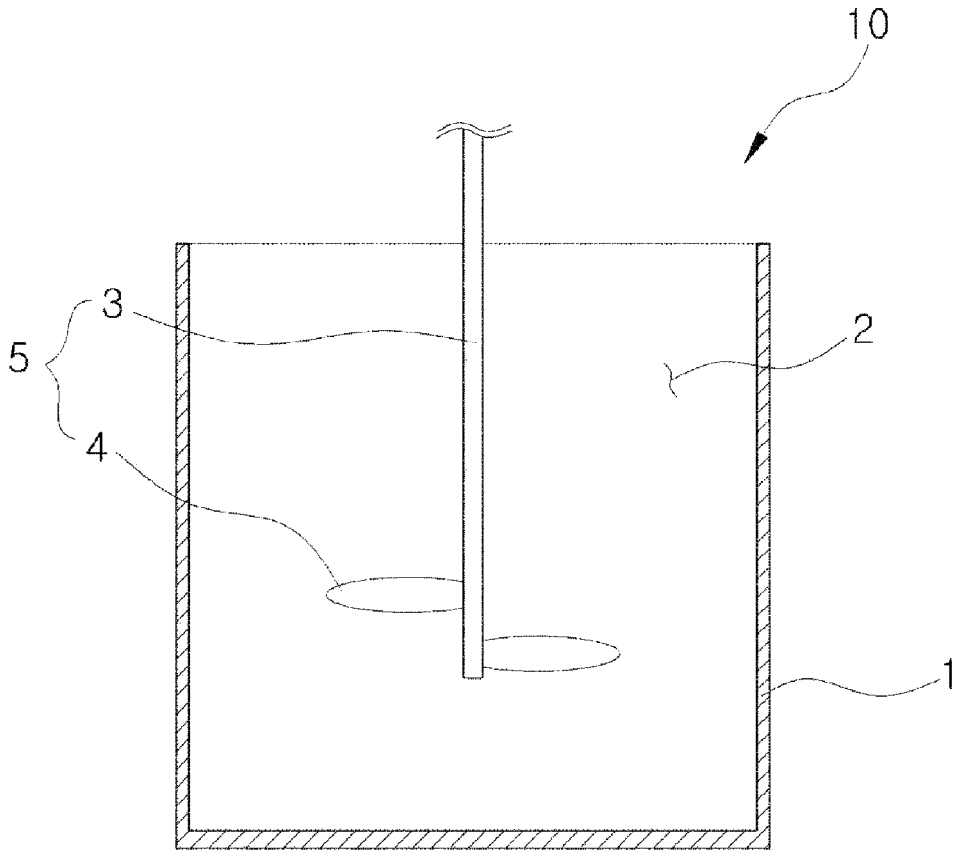
FIG. 1 Prior Art
FIG. 1 is a cross-sectional view showing the agitator according to the related art.
Figure 2:
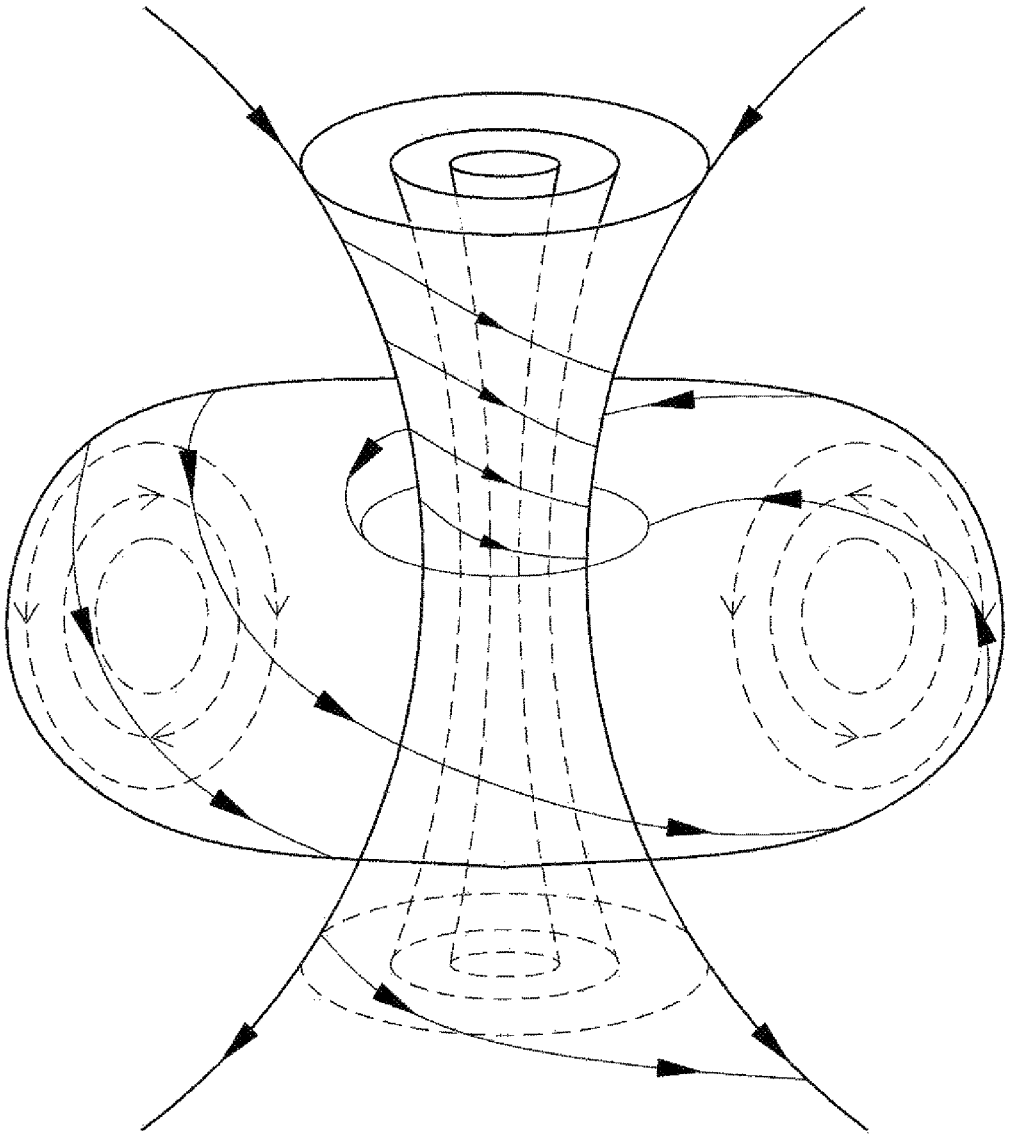
FIG. 2 Prior Art
FIG. 2 is a schematic view showing a dynamical systems structure of the fluid motion in the agitator shown in FIG. 1.

Here, the baffle 130 is not formed over the entire area of the body 110 so as to bisect the entire body 110. And the baffle 130 may be formed only in a predetermined area so as not to impede the rotation of the impeller 120. Therefore, the agitator 1000 having improved agitating capability according to the exemplary embodiment of the present invention allows continuous flow according to the related art as shown in FIG. 2 to be divided in an area in which the baffle 130 is formed and to be mixed in an area in which the baffle 130 is not formed.

That is, since the agitator 1000 having improved agitating capability according to the exemplary embodiment of the present invention has different shapes of streamlined surface (dynamical systems structure) in a region in which the baffle 130 exists and a region in which the baffle 130 does not exist. Since the dynamical systems structure are different from each other, it causes two distinct streamlined surfaces to be crossed each other such that the streamlined surface having the invariant surface according to the related art is effectively broken, thereby making it possible to maximize the mixing performance.

More specifically, as shown in FIG. 5, in the agitator 1000 having improved agitating capability according to the exemplary embodiment of the present invention, an angle α formed by two lines connecting both ends of the baffle 130 to the shaft is preferably in the range of 90 to 270 degrees, when viewing an inner side of the body 110 from the top.

When the baffle 130 is formed to have an angle α smaller than 90 degrees, a mixing improving effect by the baffle 130 may be insignificant, and when the baffle 130 is formed to have an angle α larger than 270 degrees, the baffle 130 may serve to bisect the flow of the fluid to thereby impede remixing. Therefore, in the agitator 1000 having improved agitating capability according to the exemplary embodiment of the present invention, the baffle 130 is formed to have an angle α that is in the range of 90 to 270 degrees based on the central shaft, when viewing the inner side of the body 110 from the top.

When a plurality of baffles 130 are formed in different positions in a longitudinal direction of the body 110 (the plurality of baffles 130 do not exist in the same position when viewing the inner side of the body 110 from the top), even though an angle α at which a single baffle 130 is formed based on the central shaft is smaller than 90 degrees, it is possible to expect that the mixing performance will be improved due to effective division of dynamical systems structure by the plurality of baffles 130.

An example in which the plurality of baffles 130 are formed will be described again below.

As shown in FIG. 6, in the case of the left in which the baffle 130 does not exist, the secondary rotational flow on the cross section has a single rotation center (elliptic point); however, in the case of the right in which the baffle 130 exists, the secondary rotational flow on the cross section has two rotating centers.

When a fluid material alternately moves circumferentially to the right side and the left side by the rotation of the impeller, experiencing two completely different cross-sectional rotational flows, the streamlined surface is broken while being twisted (homoclinic/heteroclinic tangling), thereby generating the chaos flow, as shown in FIG. 6B.

The present invention uses this scheme in which completely different flow patterns are generated in different regions within the agitator to thereby break the streamlined surfaces and the chaos flow is thus generated to thereby improve the mixing performance. For reference, dynamical structures in cross sections shown in FIG. 6 and subsequently are shown with respect to a case in which the impeller forms axial flow in a propeller format. The dynamical structures in cross sections may be different according to a shape and a size of the impeller. However, in the present invention, the principle in which a fluid material alternately moves along different dynamical structures formed by the baffle through the rotation of the impeller such that chaos is generated, thereby improving the mixing performance thereof may be unchangingly used.

Meanwhile, the baffle has been used even in the related art. However, the baffle according to the related art, which is a vertical baffle formed on a wall surface of the body 110 in a longitudinal direction thereof, may form a portion in which the flow of a fluid may be congested in a portion adjacent to a specific surface of the baffle according to the related art as the impeller 120 rotates in a specific direction and may consume significant amounts of power due to an increase in the flow resistance. Particularly, it may be expected that the mixing performance will be locally improved only in the vicinity of a portion in which the baffle according to the related art exists.

However, the agitator 1000 having improved agitating capability according to the exemplary embodiment of the present invention includes a horizontal baffle 130 such that a region in which the baffle 130 exists and a region in which the baffle 130 does not exist are periodically repeated during a rotating process of the fluid material. Therefore, the entire flow field within the agitator is disturbed, such that the trajectories of most fluid materials in the flow field are chaotically formed, thereby improving the mixing performance.

Particularly, in the case of a fluid material having high viscosity that may not expect the turbulent flow to be formed or a fluid material having a slow rotating speed, it may be expected that the above-mentioned mixing mechanism will significantly improve the mixing performance, as compared to the case in which the baffle does not exist.

Figure 7:
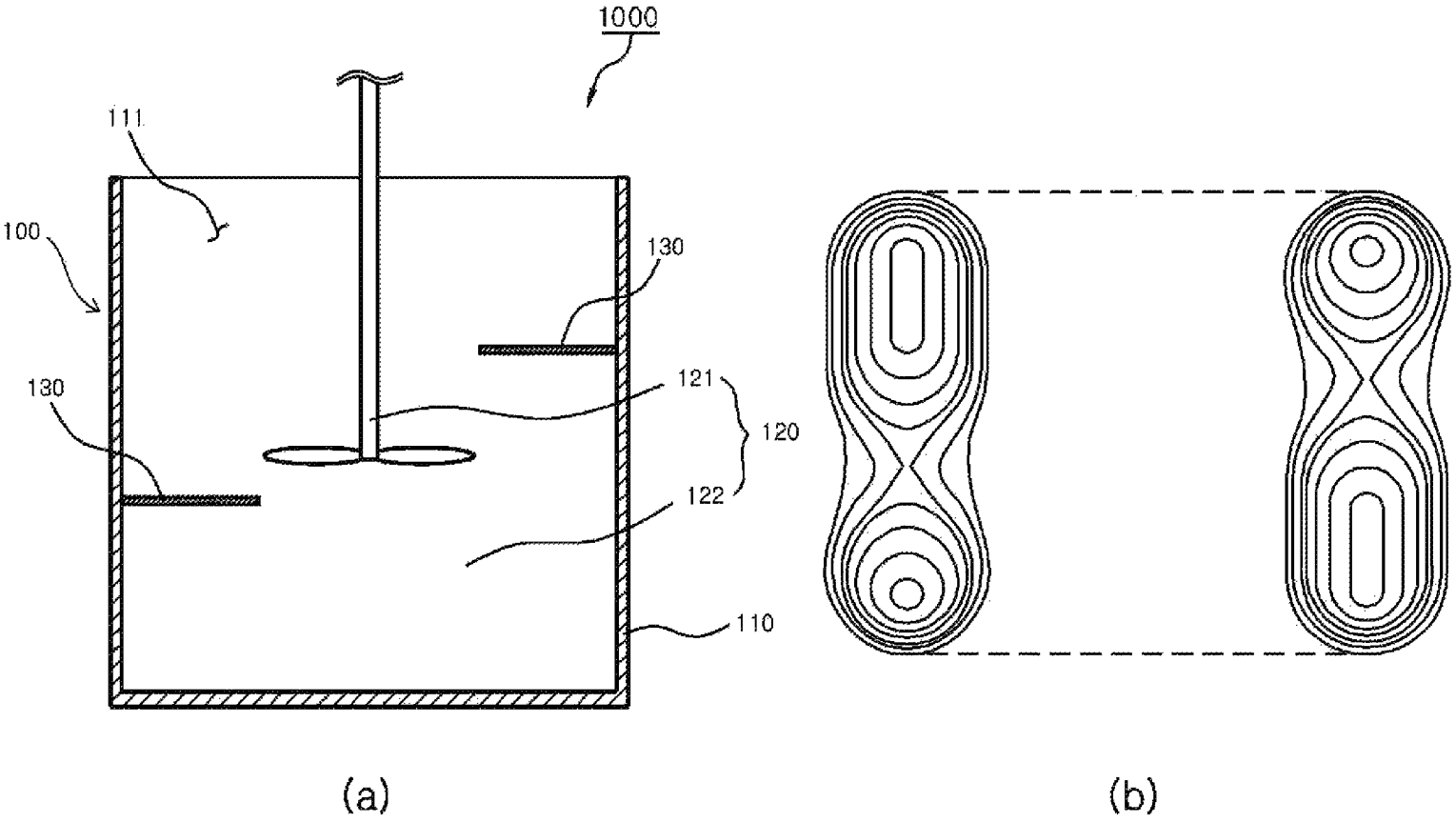
FIG. 7A is a cross-sectional view showing an agitator having improved agitating capability according to another exemplary embodiment of the present invention.
FIG. 7B is a schematic view showing two distinctive cross-sectional dynamical systems structures of the fluid motion in an agitating vessel of the agitator shown in FIG. 7A.

FIG. 7 is a cross-sectional view showing an agitator 1000 having improved agitating capability according to another exemplary embodiment of the present invention.

As shown in FIG. 7, an agitator 1000 having improved agitating capability according to the exemplary embodiment of the present invention may have the plurality of baffles 130 formed therein.

FIG. 7A shows an example in which horizontal baffles 130 are formed in the body 110 of the agitator 1000 at a left lower portion and a right upper portion in the drawing.

As shown in FIG. 7B, on the left, the baffle 130 is positioned at a lower portion such that a dynamical system configured of a large cross-sectional rotational flow at an upper portion and a small cross-sectional rotational flow at a lower portion based on the baffle 130 (positioned at the lower portion in the drawing) is formed, and on the right, the baffle 130 is positioned at an upper portion such that a dynamical system configured of a small cross-sectional rotational flow at an upper portion and a large cross-sectional rotational flow at a lower portion based on the baffle 130 (positioned at the upper portion in the drawing) is formed.

In the agitator 1000 as shown in FIG. 7, when the fluid material in the body 110 rotates by the impeller to be alternately moved to the left and the right in the drawing, the chaotic flow is generated such that the mixing performance is improved.

Figure 8:
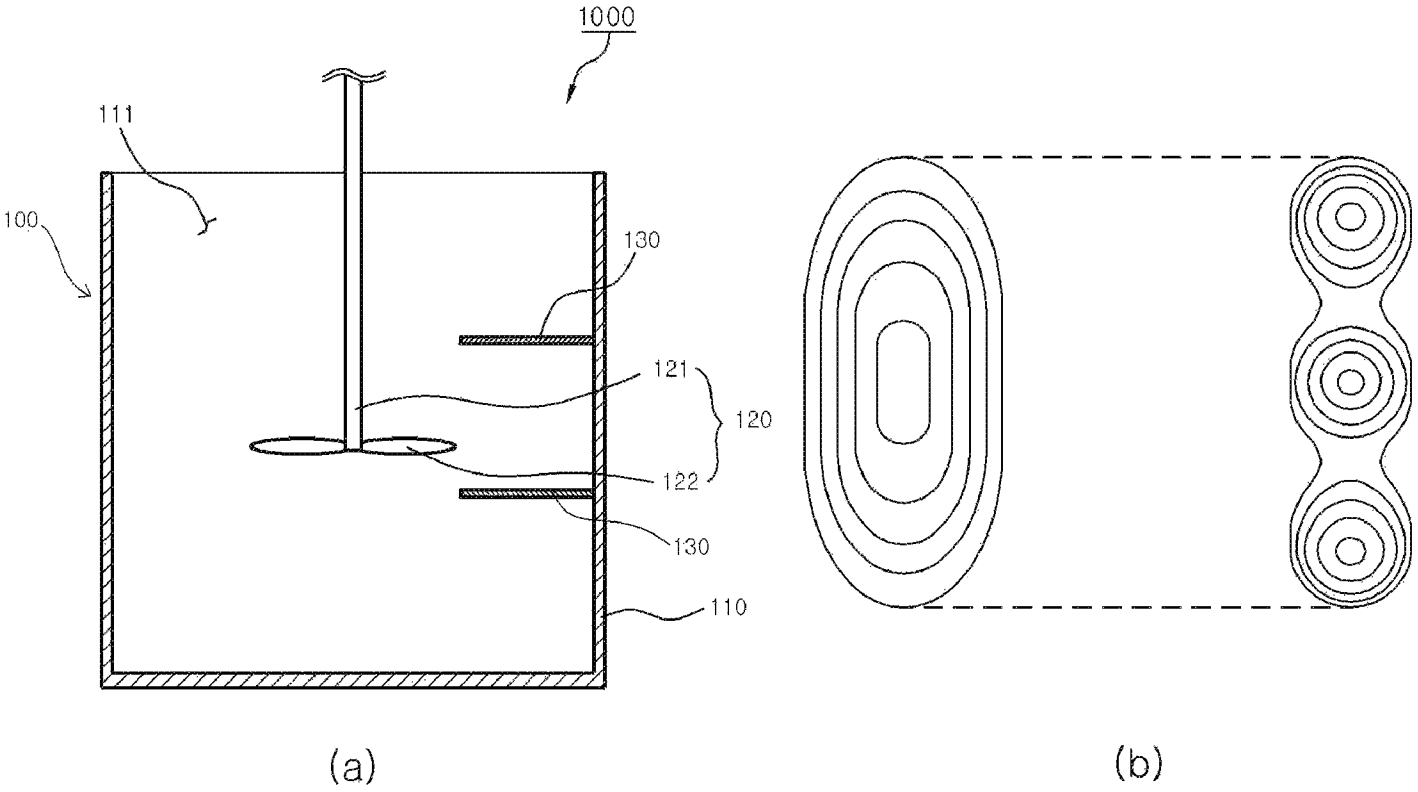
FIG. 8A is a cross-sectional view showing an agitator having improved agitating capability according to another exemplary embodiment of the present invention.
FIG. 8B is a schematic view showing two distinctive cross-sectional dynamical systems structures of the fluid motion in an agitating vessel of the agitator shown FIG. 8A.

FIG. 8 shows a case in which two baffles 130 are formed on one side. The agitator 1000 having improved agitating capability according to the exemplary embodiment of the present invention may have a plurality of baffles 130 formed in a longitudinal direction of the body 110.

More specifically, FIG. 8A shows an example in which the agitator 1000 has two baffles 130 formed in the body 110 on the right of the drawing. In this example, as shown in FIG. 8B, in the case in which the baffles 130 are formed, a dynamical system configured of three cross-sectional rotational flows (three elliptic points) is formed, and in the case of the left in which the baffles 130 are not formed, only a single large rotational flow is formed such that the fluid material in the body 110 alternately moves to the left and the right by the rotation of the impeller, thereby generating the chaos flow.

As described above, according to the present invention, the size, the number, and the position of the baffles 130 can be controlled, thereby making it possible to control the formation and the structure of the dynamical system and to ultimately control the mixing performance of the agitator 1000.

Figure 9:
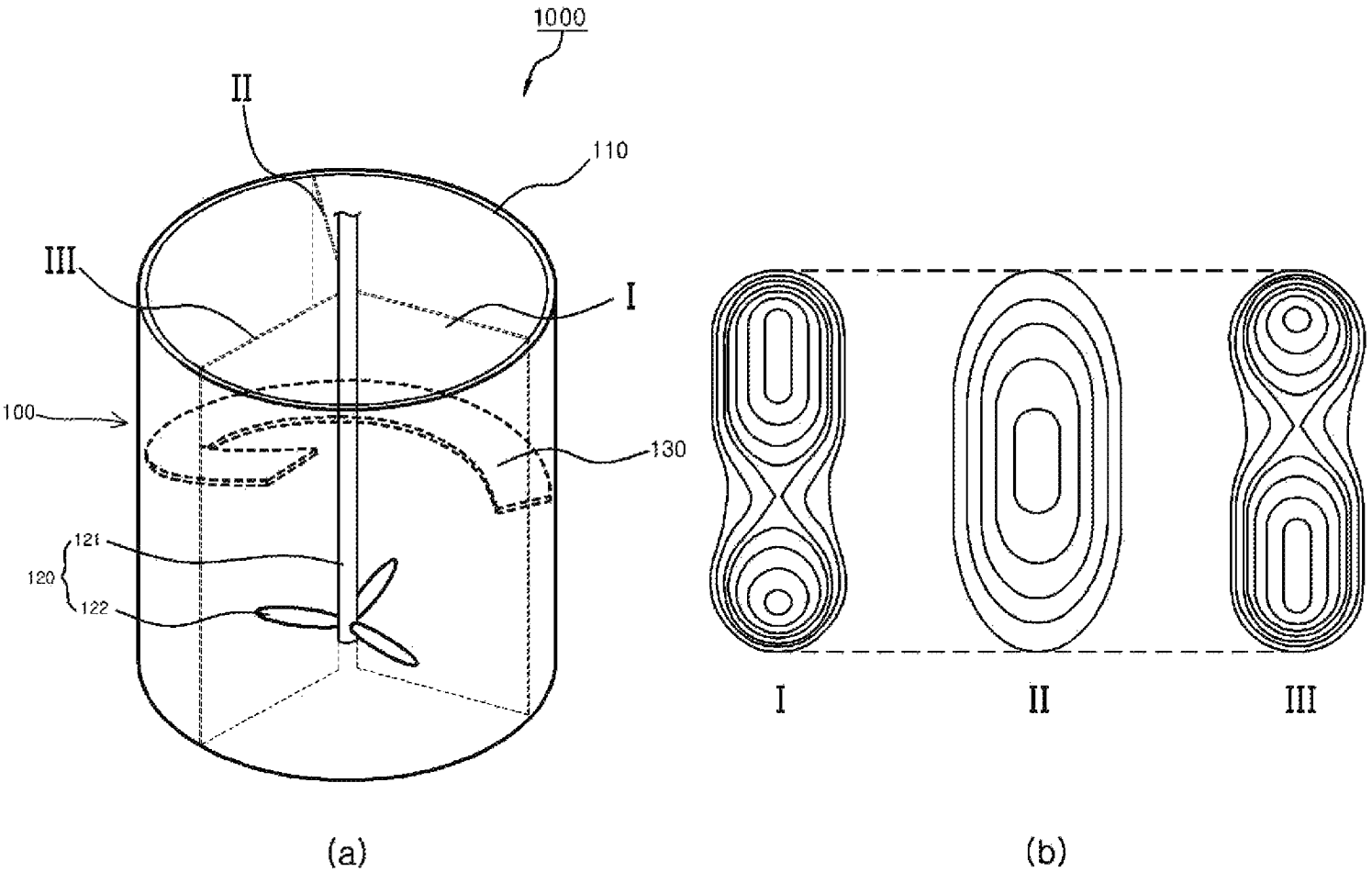
FIG. 9A is a cross-sectional view showing an agitator having improved agitating capability according to another exemplary embodiment of the present invention.
FIG. 9B is a schematic view showing continuously varying dynamical systems structures of the fluid motion in an agitating vessel with spiral baffles of the agitator shown FIG. 9A.

FIG. 9, which is a cross-sectional view showing an agitator 1000 having improved agitating capability according to another exemplary embodiment of the present invention, shows a case in which the agitating vessel 100 having the horizontal baffle 130 spirally formed along an inner wall surface of the agitator 1000 is used. This uses a characteristic in which the cross-sectional dynamical structure in a cross section is continuously changed along the baffle 130. As shown in FIG. 9, a dynamical structure configured of a small cross-sectional rotation at a lower end and a large cross-sectional rotation at an upper end is formed in an I cross section, a dynamical structure configured of a single large cross-sectional rotation is formed in a II cross section, and a dynamical structure configured of a large cross-sectional rotation at a lower end and a small cross-sectional rotation at a upper end is formed in a III cross section. When a fluid material sequentially moves along the I cross section, the II cross section, and the III cross section by the rotation of the impeller 120, the chaos motion of the fluid material is formed, thereby making it possible to expect that the mixing performance will be improved.

Figure 10:
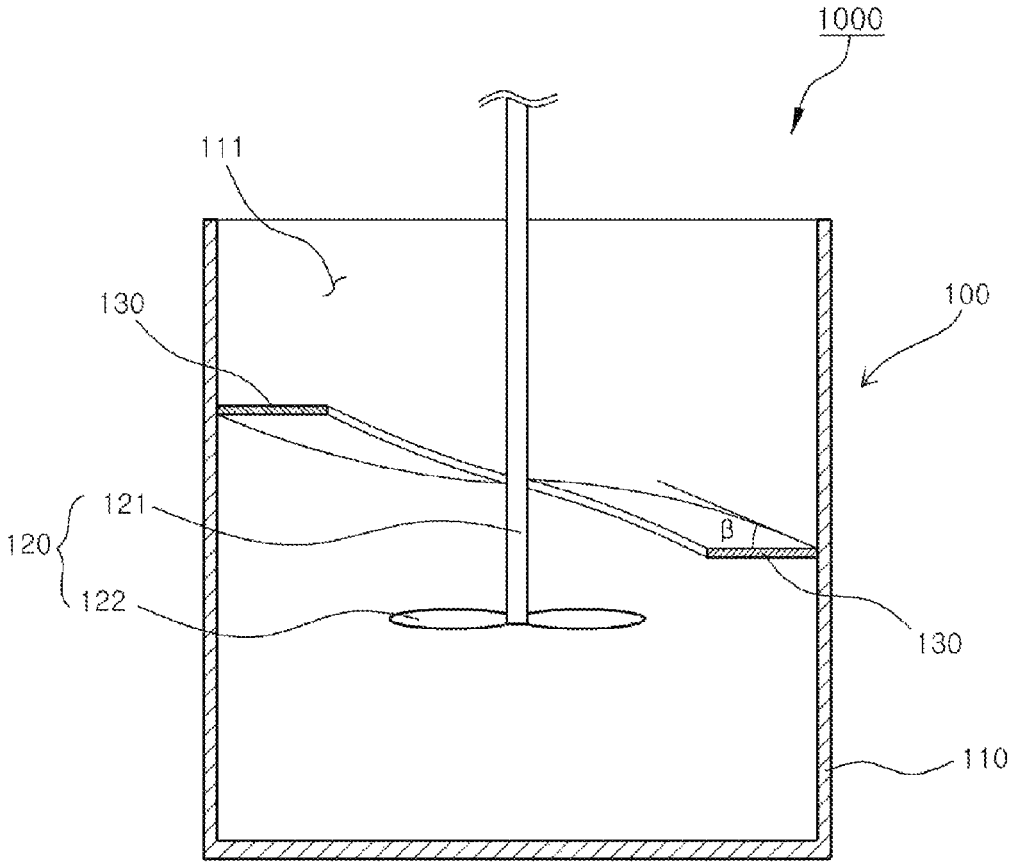
FIG. 10 is a cross-sectional view of the agitator shown in FIG. 9.

FIG. 10, which is a cross-sectional view of the agitator 1000 shown in FIG. 9, shows an example in which the baffle 130 is formed horizontally on its cross section and the baffle 130 is formed to have the continuous spiral shape along the inner wall surface of the agitator 1000.

Here, the spiral baffle 130 may be formed to have various angles β. In the present invention, the angle β of the spiral baffle 130 indicates an angle formed by a surface in parallel with a bottom surface of the body 110 based on the wall surface of the body 110 at a specific point and a surface in which the baffle 130 is formed along the wall surface.

The spiral baffle 130 may also be formed to have the same angle β in any position. In addition, the angle β may be changed along the inner wall surface of the body 110.

Figure 11:
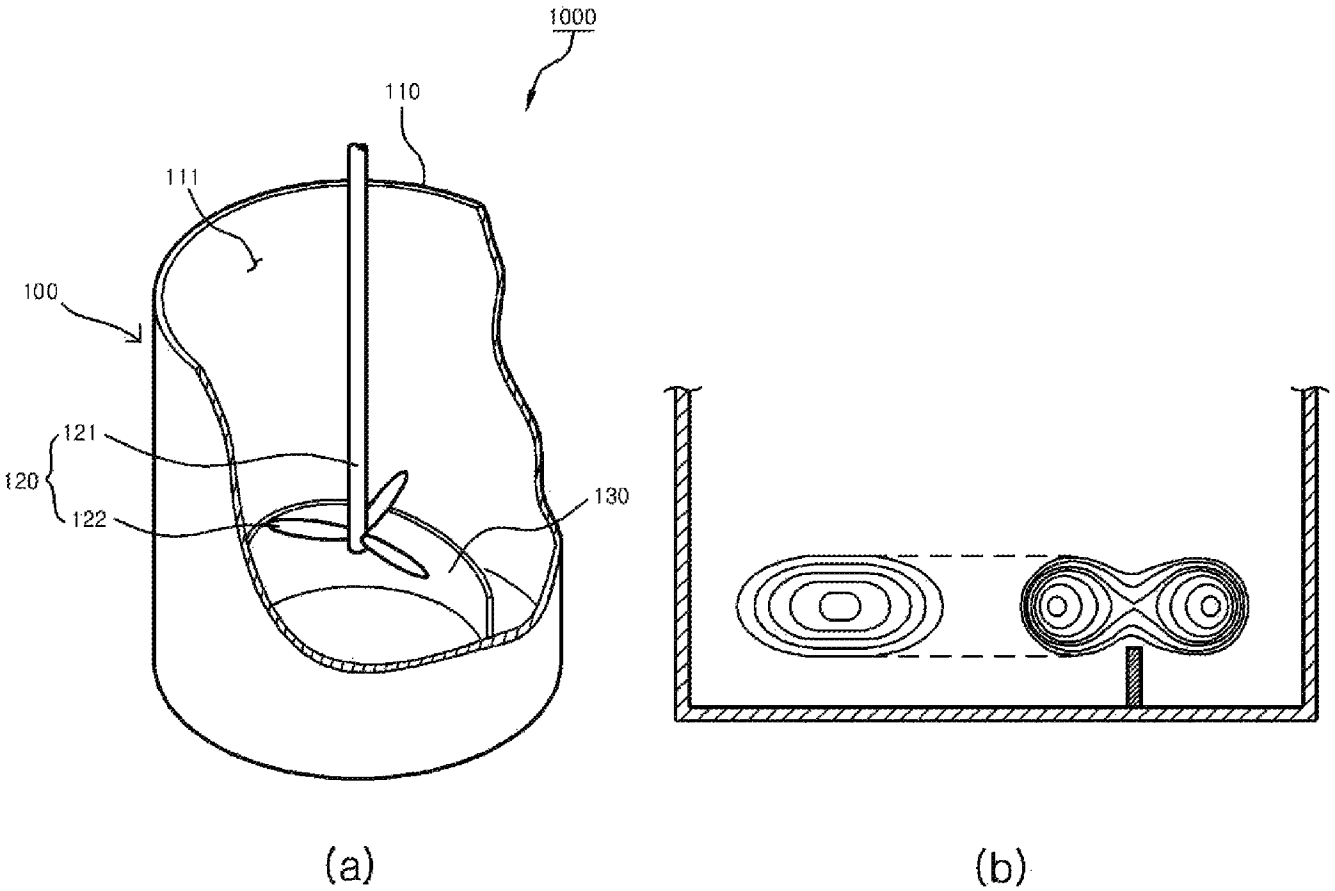
FIG. 11A is a cross-sectional view showing an agitator having improved agitating capability according to another exemplary embodiment of the present invention.
FIG. 11B is a schematic view showing two distinctive dynamical systems structures of the fluid motion in an agitating vessel of the agitator shown FIG. 11A.

FIG. 11, which is a view showing an agitator 1000 having improved agitating capability according to another exemplary embodiment of the present invention, shows an example in which the agitating vessel 100 having the baffle 130 formed in a vertical direction to an inner lower surface of the body 110 of the agitator 1000 (that is, a length direction of the body 110) is used.

As shown in FIG. 11B, in the case in which the baffle 130 is vertically formed in the body 110, a cross-sectional dynamical systems structure configured of a single large cross-sectional rotation is formed in the left region in which the baffle 130 does not exist based on the central shaft in FIG. 11B, and a dynamical structure configured of two small cross-sectional rotations is formed in the right region in which the baffle 130 exists based on the central shaft in FIG. 11B.

Therefore, the material alternately moves along two different dynamical systems by the rotation of the impeller, such that the chaos flow is generated, thereby making it possible to expect that the mixing performance will be improved.

The present invention is not limited to the above-mentioned exemplary embodiments, and may be variously applied, and may be variously modified without departing from the gist of the present invention claimed in the claims.

The invention claimed is:

1. An agitating vessel of an agitator mixing fluid, the agitating vessel comprising:

a body having a hollow inner space so that fluid is stored therein;

a rotating unit installed inside the hollow inner space to agitate the fluid; and a horizontal baffle having a plate shape, one end of which is attached to and along an inner wall surface of the hollow inner space of the body and the other end of which is a free end, wherein the plate shape of the baffle is formed in a vertical direction to a central shaft of the rotating unit and in parallel with a bottom surface of the hollow inner space of the body so that two rotations of the fluid are formed above and under the horizontal baffle, wherein the baffle forms a single piece of plate and is extended and attached to the inner wall surface over a range of 90 to 270 degrees around the central shaft with no space between the baffle and the inner wall surface, when viewing an inner side of the body from the top.

2. The agitating vessel of claim 1, wherein the baffle is formed in plural.

3. An agitating vessel of an agitator mixing fluid, the agitating vessel comprising:

a body having a hollow inner space so that fluid is stored therein; and a rotating unit installed inside the hollow inner space to agitate the fluid; and a vertical baffle having a plate shape attached to a bottom surface of the hollow inner space of the body, the bottom surface being a lowest elevational level of the agitation vessel, wherein the vertical baffle forms a single piece of plate and the plate shape of the vertical baffle is formed in a vertical direction to the bottom surface of the hollow inner space, and extended and attached to the bottom surface along a predetermined length around a central shaft of the rotating unit with no space between the vertical baffle and the bottom surface so that two rotations of the fluid are formed at both sides of the vertical baffle.

* * * * *